US005994010A

United States Patent [19]

Tanaka et al.

[11] Patent Number: 5,994,010

[45] Date of Patent: Nov. 30, 1999

[54] ORGANIC PHOTORECEPTOR FOR ELECTROPHOTOGRAPHY

[75] Inventors: Takashi Tanaka; Mitsuru Narita, both of Kawasaki, Japan

[73] Assignee: Fuji Electric Co., Ltd., Kanagawa, Japan

[21] Appl. No.: 09/007,046

[22] Filed: Jan. 14, 1998

[30] Foreign Application Priority Data

Jan. 17, 1997 [JP] Japan ..... 9-006038

[51] Int. Cl.[6] ..... G03G 5/06

[52] U.S. Cl. ..... 430/56; 430/58.05; 430/58.45; 430/58.75; 430/58.8

[58] Field of Search ..... 430/56, 58, 58.05

[56] References Cited

U.S. PATENT DOCUMENTS 4,654,288 3/1987 Hiro et al. ..... 430/67
4,699,865 10/1987 Mitsuhashi ..... 430/102

FOREIGN PATENT DOCUMENTS 61-112153 5/1986 Japan .

*Primary Examiner*—Roland Martin
*Attorney, Agent, or Firm*—Venable; Frank J. Frank; Ashley J. Wells

[57] ABSTRACT

An organic photoreceptor for electrophotography including a substrate which is electrically conductive; and an organic photosensitive layer which is formed on the substrate, which includes a photoconductive material, and which has a surface having a differential hardness corresponding to a 20 $\mu$m or less change in width of a scratch formed on the surface for every 10 g change in vertical load during perpendicular loading with 10 g or more pressure on the surface when a test for evaluating differential hardness is performed by moving the photoreceptor to a predetermined position at a constant speed of 30 mm/minute under a load in a direction perpendicular to the surface through a conical indenter to make the scratch on the surface, which conical indenter is one of a sapphire or diamond conical indenter having a conical tip portion including an apex having a hemisphereical shape with a diameter of 0.01 mm and a conical angle of 90°.

2 Claims, 1 Drawing Sheet

ORGANIC PHOTORECEPTOR FOR ELECTROPHOTOGRAPHY

This application is based on Patent Application No. 09-006,038 filed Jan. 17, 1997 in Japan, the content of which is incorporated hereinto by reference.

BACKGROUND OF THE INVENTION

1. Field of the Invention

The present invention relates to a photoreceptor useful in the field of electrophotography and a method for estimating the durability of the photoreceptor. More particularly, the present invention relates to an electrophotographic organic photoreceptor using an organic photoconductive material and a method for estimating its durability susceptible to the differential hardness of a photosensitive layer that serves as one of building blocks for the photoreceptor.

2. Description of the Prior Art

Heretofore, inorganic photoreceptors have been used as electrophotographic photoreceptors. Each of them uses an inorganic photoconductive material as a photoconductive material, such as selenium, cadmium sulfide, amorphous silicon, or zinc oxide. In recent years, however, some of highly polymerized compounds, such as poly-N-vinylcarbazoles, polyvinyl anthracenes, phthalocyanine compounds, and bisazo compounds, have been studied and developed as organic photo-conductors (OPCs) having their own electric conductivities which vary in response to receiving light. Photoreceptors using at least one of these OPCs (hereinafter, referred as OPC photoreceptors) have been also studied and developed, and thus some of them have been put to practical use. In the following description, any OPC that can be used in the OPC photoreceptor will be also referred as an organic photoconductive material.

The OPC photoreceptor comprises an electrically conductive substrate and an organic photosensitive layer formed thereon. The organic photosensitive layer includes one of the above organic photoconductive materials and consists of two layers, a charge generation layer and a charge transport layer, which have their own functions.

An image formation can be carried out by the electrophotographic process using such an OPC photoreceptor. In general, the image-forming process includes the steps of developing and cleaning. Namely, the process includes the steps of:

- uniformly charging a surface of the OPC photoreceptor in the absence of light by causing a corona discharge;
- forming a latent image of characters, figures, and the like of a source document on the charged surface of the OPC photoreceptor;
- developing the latent image by adhering toner particles to the latent image by virtue of the electric field created by the charges on the photoreceptor;
- transferring the developed toner particles on the photoreceptor to paper by corona charging the back of the paper with a charge opposite to that of the toner particles and permanently fixing the image to the paper by melting the toner into the paper surface; and
- discharging and cleaning the photoreceptor of any excess toner using coronas, lamps, brushes and/or scraper blades, recovering the photoreceptor for reuse.

Comparing with the inorganic photoreceptor, by the way, the OPC photoreceptor is far superior in membrane-formability, light weight properties, high productivity, and so on, but inferior in sensitivity, durability, and stability to a change in its surroundings. Among these disadvantages, for example, the durability problem relates to the differential hardness of the OPC photoreceptor. The differential hardness of the surface of the OPC photoreceptor varies with physical or chemical conditions including the composition or molecular weight of a resin binder used as a binding agent and the ratio of the resin binder to the photoconductive material. Therefore, it is possible to increase the durability of the OPC photoreceptor by improving the differential hardness thereof by the ways of selecting appropriate materials for preparing each of layers of the OPC photoreceptor and appropriately arranging the configuration of these layers.

Generally, the photosensitive layer is positioned on the top of the OPC photoreceptor, so that the surface of the former is provided as the surface of the latter. Thus, the surface of the photosensitive layer is subject to various stresses from the outside. During the step of development, for example, the OPC photoreceptor is exposed to mechanical stresses such as friction caused by contacting with paper, toner, carrier, or the like. During the cleaning step, furthermore, it is exposed to mechanical stresses such as pressure by the cleaner and friction caused by contacting with fine particles (such as paper debris, residual toner particles, and residual carrier particles) being remained on the surface of the photosensitive layer. If the differential hardness of the OPC photoreceptor is low while the cleaning power is strong, the photosensitive layer is easily subject to the effects of the above fine particles on the surface of the photoreceptor. If the photosensitive layer is made of a breakable firm material, furthermore, the impact of producing friction with the fine particles causes a local brittle fracture (micro-fracture) in the surface of the photosensitive layer. This kind of trouble leads to a defective image formation at the time of the development in the next rotation of the OPC photoreceptor (in the form of a drum). Suppose the step of cleaning is completed even though the toner particles remain in a defective (fractured) portion of the drum's surface, the black dot defect in the image is produced.

Incidentally, the conventional cleaning methods include a blade cleaning method and a magnetic blush cleaning method. Among them, the blade cleaning method may be principally applied for the photosensitive layer having a small differential hardness. For preventing the photosensitive layer from causing the local brittle fracture, a man skilled in the art uses a low hardness cleaning blade or applies lubricant powder (setting powder) on a surface of the photosensitive layer to reduce the friction between the photoreceptor and the blade. However, the low hardness cleaning blade increases the possibility of causing the troubles such as a blurred image running in hot and humid surroundings. Even though the lubricant powder is applied, an image defect can be occurred as a result of causing the local brittle fracture when the efficacy of the lubricant powder is decreased as a result of repeating the printing process many times.

SUMMARY OF THE INVENTION

A first object of the invention is to provide an organic photoreceptor for an electrophotography that does not cause any local brittle fracture in its surface.

A second object of the invention is to provide a method for estimating the durability of an organic photoreceptor for an electrophotography that does not cause any local brittle fracture in its surface.

In a first aspect of the present invention, there is provided an organic photoreceptor for an electrophotography having the differential hardness of a surface thereof and comprising an electrically conductive substrate on which an organic photosensitive layer including a photoconductive material is formed, wherein the differential hardness corresponds to 20 μm or less change in a width of a scratch formed on the surface every 10 g change in vertical load at a time of perpendicularly loading 10 g or more pressure on the surface when a test for evaluating the differential hardness is performed by moving the photoreceptor to a predetermined position at a constant speed of 30 mm/minute under the load in a direction perpendicular to the surface through a conical indenter to make the scratch on the surface, where the conical indenter is of a sapphire or diamond conical indenter having a conical tip portion with its apex in the shape of a hemispherical with a diameter of 0.01 mm and a conical angle of 90°.

Here, the amount of change in a width of scratch formed on the surface may be in the range of 3 to 15 μm.

In a second aspect of the present invention, there is provided a method for estimating durability of a photoreceptor, comprising the steps of:

providing a surface of the photoreceptor as a sample, determining the differential hardness of the sample by moving the photoreceptor to a predetermined position at a constant speed of 30 mm/mines under the load in a direction perpendicular to the surface through a conical indenter to make the scratch on the surface, where the conical indenter is of a sapphire or diamond conical indenter having a conical tip portion with its apex in the shape of a hemispherical with a diameter of 0.01 mm and a conical angle of 90°; and making the determination that the sample has a good durability if the differential hardness corresponds to 20 μm or less change in a width of a scratch formed on the surface every 10 g change in vertical load at a time of perpendicularly loading 10 g or more pressure on the surface.

The above and other objects, effects, features and advantages of the present invention will become apparent from the following description of embodiments thereof taken in conjunction with the accompanying drawings.

DETAILED DESCRIPTION OF THE PREFERRED EMBODIMENTS

Figure 1:
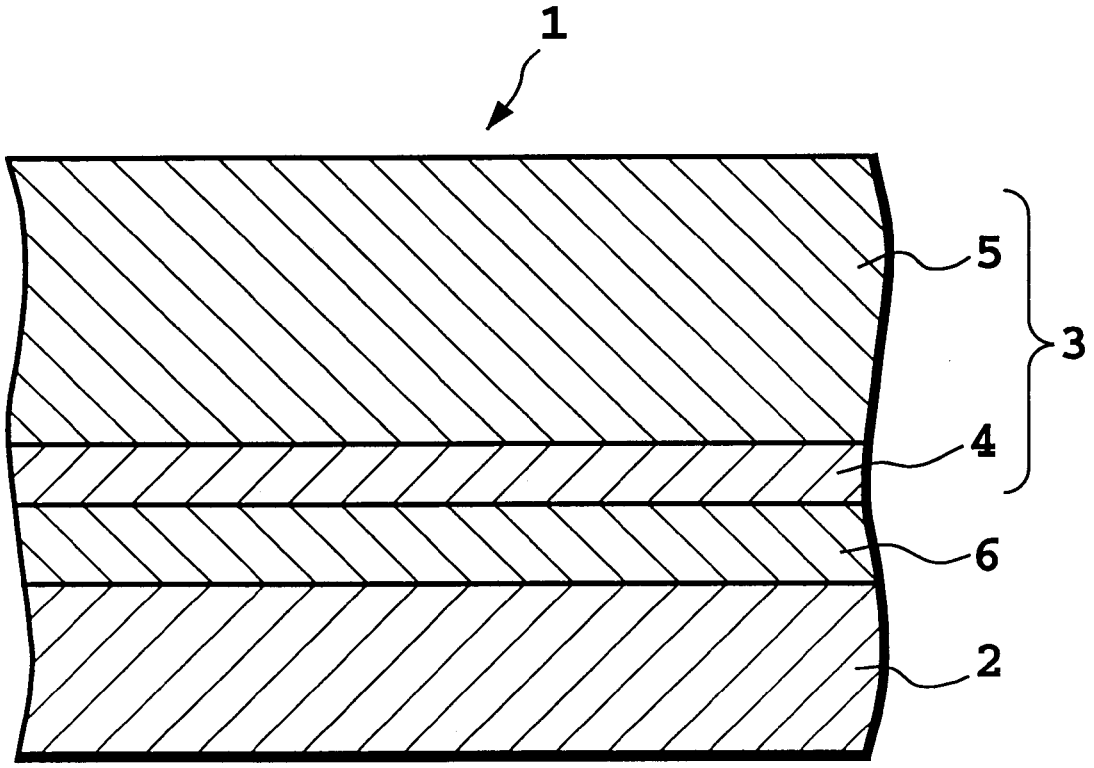
FIG. 1 is a cross sectional view of an OPC photoreceptor as one of preferred embodiments of the present invention.

Refering now to FIG. 1, we will explain the concrete examples of the present invention.

An OPC photoreceptor 1 is the one having functionally distinguished layers and comprises a conductive substrate 2 and a photosensitive layer 3. As shown in the figure, the layer 3 is laminated on the conductive substrate 2 and consists of two functionally distinguished layers, a charge generation layer 4 and a charge transport layer 5 (it is preferable that the latter is formed on the former as shown in the figure). Furthermore, there is an under coat layer 6 between the conductive substrate 2 and the photosensitive layer 3.

The conductive substrate 2 may be in the shape of board, sheet, belt, cylinder, or the like. Also, the conductive substrate 2 may be made of a metal material such as aluminum, aluminum alloy, or copper. Alternatively, it may be made of a metal or plastic covered with aluminum, aluminum alloy, tin oxide, or the like by means of a vacuum deposition. Furthermore, it may be made of a metal or plastic covered with a coating composition prepared by mixing a conductive material with a binder resin, or a plastic or the like comprising a conductive material.

The under coat layer 6 may be provided in case of necessity for improving an adherence between the conductive substrate 2 and the photosensitive layer 3 or for controlling an injection of charge carriers from the conductive substrate 2 to the photosensitive layer 3. The under coat layer 6 is mainly comprising a resin selected from the group of polyvinyl alcohol, melamine resin, phenol resin, polyamide resin, and so on. A thickness of the under coat layer 6 is preferably from 0.05 to 20 μm and more preferably from 0.05 to 10 μm.

The charge generation layer 4 may be formed by applying a coating liquid on the under coat layer 3 or directly on the conductive substrate 2. The coating liquid may be prepared by dispersing the powder of an organic photoconductive material such as phthalocyanine, perylene, or bisazo pigment into a binder resin liquid such as polyvinyl butyral resin or polyacrylate resin. A thickness of the charge generation layer 4 is preferably from 0.1 to 1 μm.

The charge transport layer 5 mainly comprises a charge transport material and a binder resin. The charge transport material may be selected from the group of:

hydrazon compound (ex. chemical formula I-1 or I-2);

(I-1)

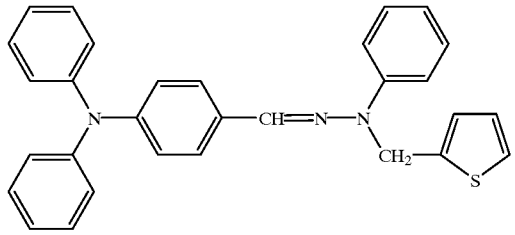

(I-2)

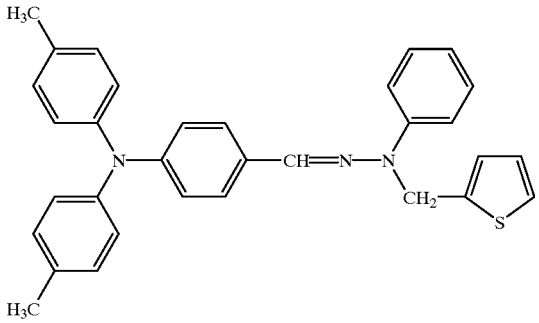

triaryl amine compound (ex. chemical formula II-1 or II-2); and (II-1)

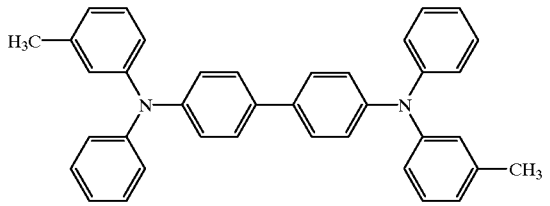

(II-2)

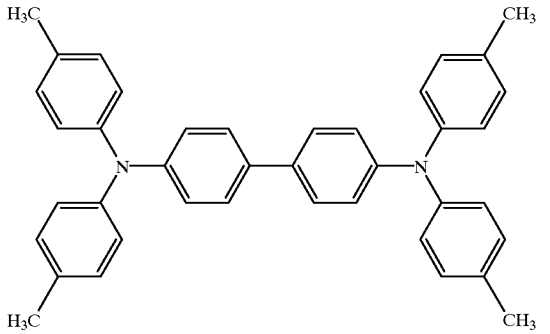

styryl amine compound (ex. chemical formula III-1 or III-2).

(III-1)

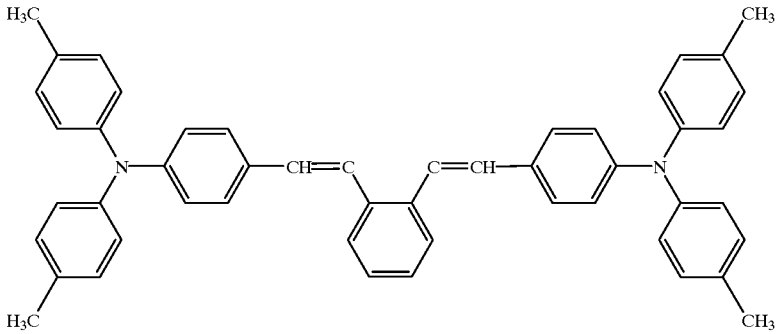

(III-2)

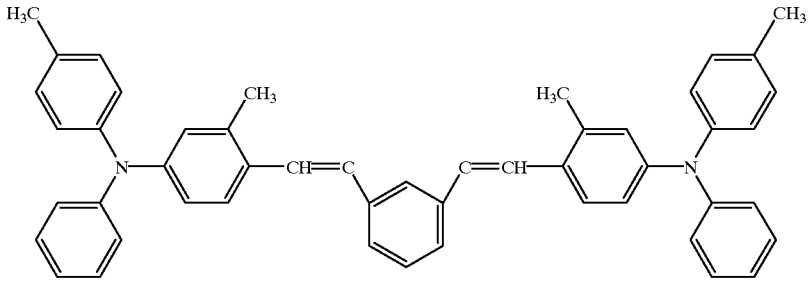

The binder resin for the charge transport layer 5 may be selected from the resins of polyvinylbutyral, polycarbonate, polyester, and so on. Preferably, the content of the charge transport material in the charge transport layer 5 is 30 to 70% by weight based on the total solid content of the resin binder.

A thickness of the charge transport layer 5 is preferably 10 to 50 μm and more preferably 15 to 40 μm.

For the OPC photoreceptors of the following embodiments, an evaluation of the differential hardness of their respective photosensitive layers 3 was performed by the measuring method including the steps:

holding a photoreceptor to be measured on a sample holder of a HEIDON 14 type surface measuring apparatus (manufactured by Shinto Kagaku Co., Ltd.);

imposing a load perpendicularly on the top surface of the photoreceptor (i.e., the surface of the photosensitive layer) to be measured through a sapphire conical indenter, wherein the conical indenter has a conical tip portion with its apex in the shape of a hemisphere with a diameter of 0.01 mm and a conical angle of 90°; and moving the sample holder to the predetermined position at a constant speed of 30 mm per minutes under the load in a direction perpendicular to the surface of the photosensitive layer through the conical indenter to make a scratch on the photosensitive layer with the conical indenter. In this embodiment, by the way, the photosensitive layer receives variations in the above load during the movement of the sample holder, resulting in variations in the depth of which the conical indenter is engaged in the surface of the photosensitive layer.

Therefore, we evaluate variations in the width of the scratch instead of evaluating the variations in the depth of which the conical indenter is engaged in the surface of the photosensitive layer. The scratch's width is measured using an optical microscope (AFX-II, commercially available from Nikon Co., LTD.)

The extent of the above load variation is 10 g at a time, for example 50 g to 40 g, 40 g to 30 g, 30 g to 20 g, and 20 g to 10 g. Thus, the differential hardness of the photosensitive layer is evaluated by measuring the amount of the change in the scratch's width at the time when the amount of the change in the above load is 10 g. We judge the differential hardness of the photosensitive layer high proportionate to the decrease in the extent of the change of the scratch's width when the load applied on the photosensitive layer is changed.

In the case that the OPC photoreceptor is in the shape of a drum, the photoreceptor should be held on the sample holder so as to make scratches in a direction along an axis of the drum.

It is preferable that the differential hardness of the photosensitive layer of the photoreceptor for an electrophotography according to the present invention corresponds to 20 μm or less, preferably 3 to 15 μm, change in the scratch's width. If the change of the scratch's width is smaller than 3 μm (there is an increasing tendency to form a film of the toner). If it exceeds 15 μm, on the other hand, an influence upon the image formation begins to be observed.

The following description serves to illustrate the specific embodiments of the photoreceptor of this invention. However, the present invention is not limited to the specific embodiments thereof except as defined in the appended claims.

Embodiment 1

(1) The Process For Making a Photoreceptor

An aluminum cylinder of 30 mm in diameter and 250 mm in length was prepared as an electrically conductive substrate.

Then, 8 parts by weight of a copolymerized polyamide resin (DAIAMIDE T-170, commercially available from Daicel-Hüls Co., Ltd.) was dissolved in a mixed solvent consisting of 70 parts by weight of methanol and 30 parts by weight of n-butanol to prepare a coating liquid for making an under coat layer.

The coating liquid for making the under coating layer was applied on the above electrically conductive substrate by using a dip-coating method, resulting in the under coat layer of 0.5 μm in thickness after drying for 20 minutes at 90° C.

A dispersion mixture was prepared by mixing 10 parts by weight of disazo pigment, 10 parts by weight of polyvinylbutyral resin (S-LEC BH-S, commercially available from Sekisui Chemicals Co., Ltd.), and 100 parts by weight of cyclohexanone. Then, the dispersion mixture was diluted with 500 parts by weight of tetrahydrofuran, resulting in a coating liquid for making a charge generation layer. The coating liquid thus obtained was applied on the under coat layer by using a dip-coating method, followed by drying for 20 minutes at 90° C. As a result, a charge generation layer of 0.3 μm in thickness was obtained.

Furthermore, 10 parts by weight of a hydrazon compound represented by the chemical formula I-1 as a charge transport material and 10 parts by weight of a polycarbonate resin (BPPC, commercially available from Idemitu Kosan Co., Ltd.) as a binder were mixed together and then a phenol based oxidation inhibitor was further added into the mixture. The mixture was dissolved into 80 parts by weight of tetrahydrofuran to prepare a coating liquid for making a charge transport layer. The obtained coating liquid was applied on the charge generation layer by using a dip-coating method and then it was dried for 30 minutes at 100° C. to make a charge transport layer of 20 μm in thickness. Consequently, a photoreceptor was obtained.

(2) The Measurement of the Differential Hardness of a Photosensitive Layer's Surface of the Photoreceptor For measuring the differential hardness in this embodiment, the method described in the preceding section was used. The extent of the load variation was 10 g at a time. Thus, the differential hardness of the photosensitive layer was evaluated by measuring the amount of the change in the scratch's width at the time when the load perpendicularly applied on the photosensitive layer was changed in response to each of the variations from 50 g to 40 g, 40 g to 30 g, 30 g to 20 g, and 20 g to 10 g, respectively. The results were shown in Table 1.

In this table, therefore, the differential hardness is represented as the amount of change in the scratch's width.

(3) The Observation of a Local Brittle Fracture in the Surface of the Photoreceptor Associated with Vertical Load Variations Furthermore, an OPC photoreceptor identical with the one subjected to the above vertical load variations was loaded in an electrophotographic copying machine that comprises −6 kV corona charger, an optical system for light exposure, a developing device, a transferring and charging device, and an optical system for charge erasing exposure, and a blade cleaner. Then, a running test was performed by printing 20,000 sheets of paper under the circumstances of a temperature of 26° C. and a humidity of 60% RH. Following the completion of the running test, the generation of the local brittle fracture in the photoreceptor's surface was indirectly recognized by evaluating printed image qualities. As a result, image troubles caused by the local brittle fracture were not observed in the printed image (see Table 1), so that we concluded that the photoreceptor had been normal during the running test.

In this case, by the way, the above blade cleaner was of comprising a blade made of a silicon rubber with a rubber hardness of 66°. The blade was arranged so as to exert a blade pressure of 28 g/cm on a surface in contact with it at an angle of 25°. In addition, a developer used was of comprising 100 parts by weight of styrene-acryl based magnetic toner with 1.2 parts by weight of oxide based ceramic fine powder ($SiO_2$).

TABLE 1

| Vertical load variations | Differential Hardness | Image defects after printing 20,000 sheets |
|---|---|---|
| 20 g to 10 g | 14 μm | not observed (normal) |
| 30 g to 20 g | 13 μm | |
| 40 g to 30 g | 10 μm | |
| 50 g to 40 g | 8 μm | |

Embodiment 2

An OPC photoreceptor was prepared by the same way as that of Embodiment 1 except that the charge transport material in the coating liquid for making the charge transport layer was changed from the hydrazone compound to the above described amino compound III-1. In addition, the measurement of the differential hardness of a photosensitive layer's surface of the OPC photoreceptor (by the way of observing a local brittle fracture in the surface of the photoreceptor with vertical load variations) were also performed by the same way as those of Embodiment 1 except that the number of printing sheets was changed to 15,000 and the results were listed in Table 2. As a result, image troubles caused by the local brittle fracture were not observed in the printed image, so that we concluded that the photoreceptor had been normal during the running test.

TABLE 2

| Vertical load variations | Differential hardness | Image defects after printing 15,000 sheets |
|---|---|---|
| 20 g to 10 g | 15 μm | not observed (normal) |
| 30 g to 20 g | 12 μm | |
| 40 g to 30 g | 11 μm | |
| 50 g to 40 g | 9 μm | |

Embodiment 3

A photoreceptor was prepared by the same way as that of Embodiment 2 except that the binder material in the coating liquid for making the charge transport layer was changed from the BPPC to polycarbonate (PANLITE TS-2050, Teijin Chemicals Co., Ltd.). For determining the influence, in addition, the running test was also performed by the same way as those of Embodiment 1 without changing the number of printing sheets (i.e., 20,000 sheets). The resulting differential hardness of the photosensitive layer were listed in Table 3 to determine the influence on the image quality. As a result, image troubles caused by the local brittle fracture were not observed in the printed image, so that we concluded that the photoreceptor had been normal during the running test.

TABLE 3

| Vertical load variations | Differential hardness | Image defects after printing 20,000 sheets |
|---|---|---|
| 20 g to 10 g | 13 μm | not observed (normal) |
| 30 g to 20 g | 11 μm | |
| 40 g to 30 g | 9 μm | |
| 50 g to 40 g | 5 μm | |

Comparative Example

A photoreceptor was prepared by the same way as Embodiment 1 except that the contents of the charge transport material and the binder were changed to 14 parts by weight of the hydrazone compound and 6 parts by weight of the binder. In addition, the measurement and the running test were also performed by the same way as those of Embodiment 1 and the results were listed in Table 4.

In this Comparative Example, however, image defects (black dot defects of about 1.2 mm in diameter) were observed on the printed image after printing 1,170 sheets of paper. Furthermore, we examined a surface of the photoreceptor under an optical microscope (AFX-II, manufactured by Nicon Co., Ltd.) and concluded that these defects were caused by very small cracks of about 1.0 mm in diameter formed on the photoreceptor's surface with a deposition of toner in their center portions.

TABLE 4

| Vertical load variations | Differential hardness | Image defects after printing 1,170 sheets |
|---|---|---|
| 20 g to 10 g | 25 μm | black dots of 1.2 ϕ in diameter |
| 30 g to 20 g | 25 μm | |
| 40 g to 30 g | 23 μm | |
| 50 g to 40 g | 23 μm | |

As is evident from Embodiments 1, 2, and 3 and Comparative Example described above, the differential hardness of a photosensitive layer of the photoreceptor depends on the materials of a charge transport layer. Variations in the differential hardness are related to the charge transport material, the binder resin and the relative proportion of the content of the binder resin and the content of the charge transport material. According to the present invention, a problem of causing a local brittle fracture can be solved by an image formation using an electrophotographic photoreceptor in which the amount of change in a width of scratch formed on the photoreceptor is 20 μm or less against 10 g changes in the vertical load. Consequently, the photoreceptor according to the present invention provides an excellent image quality in spite of after printing images on a lot of sheets of paper.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An organic photoreceptor for electrophotography, comprising:

a substrate which is electrically conductive; and an organic photosensitive layer which is formed on the substrate, which includes a photoconductive material, and which has a surface having a differential hardness corresponding to a 20 μm or less change in width of a scratch formed on the surface for every 10 g change in vertical load during perpendicular loading with 10 g or more pressure on the surface when a test for evaluating differential hardness is performed by moving the photoreceptor to a predetermined position at a constant speed of 30 mm/minute under a load in a direction perpendicular to the surface through a conical indenter to make the scratch on the surface, which conical indenter is one of a sapphire or diamond conical indenter having a conical tip portion including an apex having a hemisphereical shape with a diameter of 0.01 mm and a conical angle of 90°.

2. The organic photoreceptor as claimed in claim 1, wherein the change in width of a scratch formed on the surface ranges from 3 to 15 μm.

* * * * *